US007856823B2

(12) United States Patent
Schoell

(10) Patent No.: US 7,856,823 B2
(45) **Date of Patent: *Dec. 28, 2010**

(54) PRE-HEATER COIL IN A HEAT REGENERATIVE ENGINE

(75) Inventor: Harry Schoell, Pompano Beach, FL (US)

(73) Assignee: Cyclone Power Technologies, Inc., Pompano Beach, FL (US)

( * ) Notice: Subject to any disclaimer, the term of this patent is extended or adjusted under 35 U.S.C. 154(b) by 1151 days.

This patent is subject to a terminal disclaimer.

(21) Appl. No.: 11/509,207

(22) Filed: Aug. 24, 2006

(65) Prior Publication Data

US 2007/0056288 A1 Mar. 15, 2007

Related U.S. Application Data

(60) Division of application No. 11/489,335, filed on Jul. 19, 2006, which is a continuation of application No. 11/225,422, filed on Sep. 13, 2005, now Pat. No. 7,080,512.

(60) Provisional application No. 60/609,725, filed on Sep. 14, 2004.

(51) Int. Cl.
*F01K 7/34* (2006.01)

(52) U.S. Cl. ..... 60/653; 60/670; 60/676

(58) Field of Classification Search ..... 60/653, 60/670, 676

See application file for complete search history.

(56) References Cited

U.S. PATENT DOCUMENTS

| | | | | |
|---|---|---|---|---|
| 279,270 | A * | 6/1883 | Ofeldt | 60/651 |
| 1,636,887 | A * | 7/1927 | Windell | 60/514 |
| 4,077,214 | A * | 3/1978 | Burke et al. | 60/512 |

* cited by examiner

*Primary Examiner*—Hoang M Nguyen
(74) *Attorney, Agent, or Firm*—Robert M. Downey

(57) ABSTRACT

A pre-heater arrangement in a heat regenerative engine for pre-heating water in its delivery path from a condenser sump to a combustion chamber. The engine includes a steam generator, including the combustion chamber, for producing pressurized steam. The engine further includes at least one piston and cylinder arrangement for receiving the pressurized steam in order to drive the piston within the cylinder, and a condenser for condensing steam to liquid. A conduit formed of a heat transferring material provides the delivery path from the condenser sump to the combustion chamber. The pre-heater arrangement includes at least one exhaust port associated with the cylinder for releasing steam from within the cylinder after driving the piston, and a tubular coil connected to the steam delivery conduit and wound about the cylinder, adjacent to the exhaust port, for transferring heat from the exhausted steam to the water traveling through the coil, thereby heating the water on its delivery path to the steam generator. In giving up heat to the pre-heater coil, the exhausted steam begins the process of cooling on its path from the cylinder exhaust port to the condenser where the steam is condensed to a liquid and returned to the sump.

2 Claims, 3 Drawing Sheets

PRE-HEATER COIL IN A HEAT REGENERATIVE ENGINE

This application is a divisional patent application of patent application Ser. No. 11/489,335 filed on Jul. 19, 2006, which is a continuation patent application Ser. No. 11/225,422 filed on Sep. 13, 2005, now issued U.S. Pat. No. 7,080,512 B2, which was based on U.S. Provisional patent application No. 60/609,725 filed on Sep. 14, 2004.

BACKGROUND OF THE INVENTION

1. Field of the Invention

This invention relates to a heat regenerative engine that uses water as the working fluid, and more particularly, to a pre-heater arrangement for capturing heat from exhaust steam in order to heat water in its path to a steam generator in the engine.

2. Discussion of the Related Art

In a typical engine, a considerable amount of heat is lost in exhaust. This significantly reduces the overall efficiency of the engine. In particular, in an engine that uses steam to drive pistons in cylinders, a considerable amount of heat is lost in exhaust steam that may otherwise be used to pre-heat water prior to steam generation. Capturing the heat from exhaust steam would not only be useful to pre-heat water, but would also effectively lower the temperature of the exhaust vapor prior to entering a condenser. A heat transfer arrangement of this nature would significantly increase the overall efficiency in an engine that relies on generation of steam and, thus, would be a beneficial component in a heat regenerative engine.

OBJECTS AND ADVANTAGES OF THE INVENTION

It is a primary object of the present invention to provide a pre-heater arrangement in a heat regenerative engine that captures heat from exhaust steam for pre-heating water in its delivery path to a steam generator.

It is a further object of the present invention to provide a pre-heater arrangement in a heat regenerative engine that includes a coil wound about a cylinder, adjacent to steam exhaust ports of the cylinder, and wherein vapor exiting the exhaust ports raises the temperature of the water being directed through the coil in its path to the steam generator.

It is still a further object of the present invention to provide a pre-heater arrangement in a heat regenerative engine that uses heat from exhaust steam to pre-heat water in its path to a steam generator while reciprocally cooling the exhaust vapor prior to the exhaust vapor entering a condenser, thereby contributing to the overall efficiency of the heat regenerative engine.

It is still a further object of the present invention to provide a pre-heater arrangement in a heat regenerative engine that positions a water carrying coil adjacent to steam exhaust ports of a cylinder to thereby scavenge heat that would otherwise be lost, and wherein the scavenged heat is used to pre-heat the water in the coil, thereby contributing to the overall efficiency of the heat regenerative engine.

These and other objects and advantages of the present invention are more readily apparent with reference to the detailed description and accompanying drawings.

SUMMARY OF THE INVENTION

The present invention is directed to a pre-heater arrangement in a heat regenerative engine for pre-heating water in its delivery path from a condenser sump to a combustion chamber. The engine includes a steam generator, including the combustion chamber, for producing pressurized steam. The engine further includes at least one piston and cylinder arrangement for receiving the pressurized steam in order to drive the piston within the cylinder, and a condenser for condensing steam to liquid. A conduit formed of a heat transferring material provides the delivery path from the condenser sump to the combustion chamber. The pre-heater arrangement includes at least one exhaust port associated with the cylinder for releasing steam from within the cylinder after driving the piston, and a tubular coil connected to the steam delivery conduit and wound about the cylinder, adjacent to the exhaust port, for transferring heat from the exhausted steam to the water traveling through the coil, thereby heating the water on its delivery path to the steam generator. In giving up heat to the pre-heater coil, the exhausted steam begins the process of cooling on its path from the cylinder exhaust port to the condenser where the steam is condensed to a liquid and returned to the sump.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
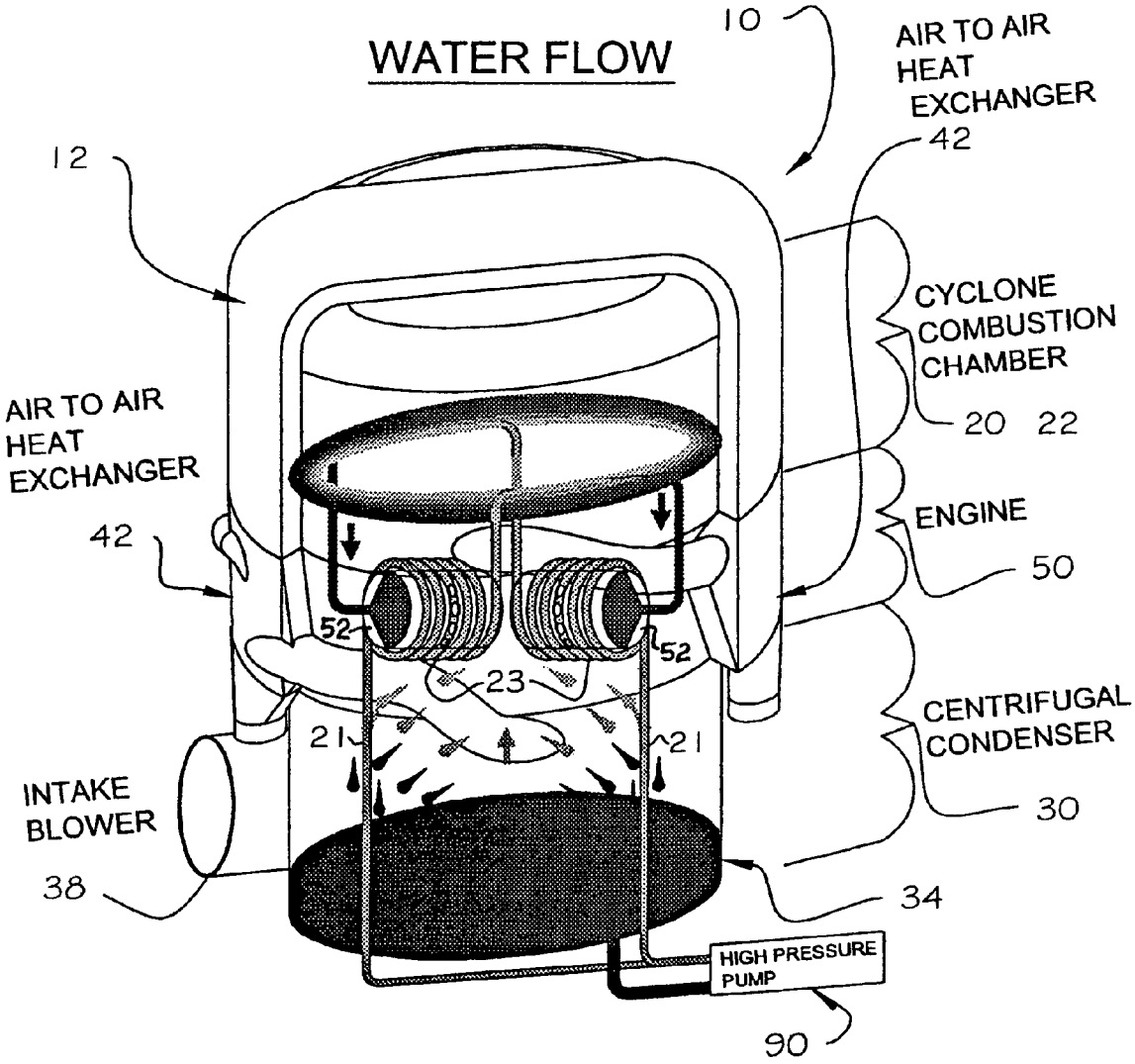
FIG. 1 is a general diagram illustrating water and steam flow through a heat regenerative engine.
Figure 2:
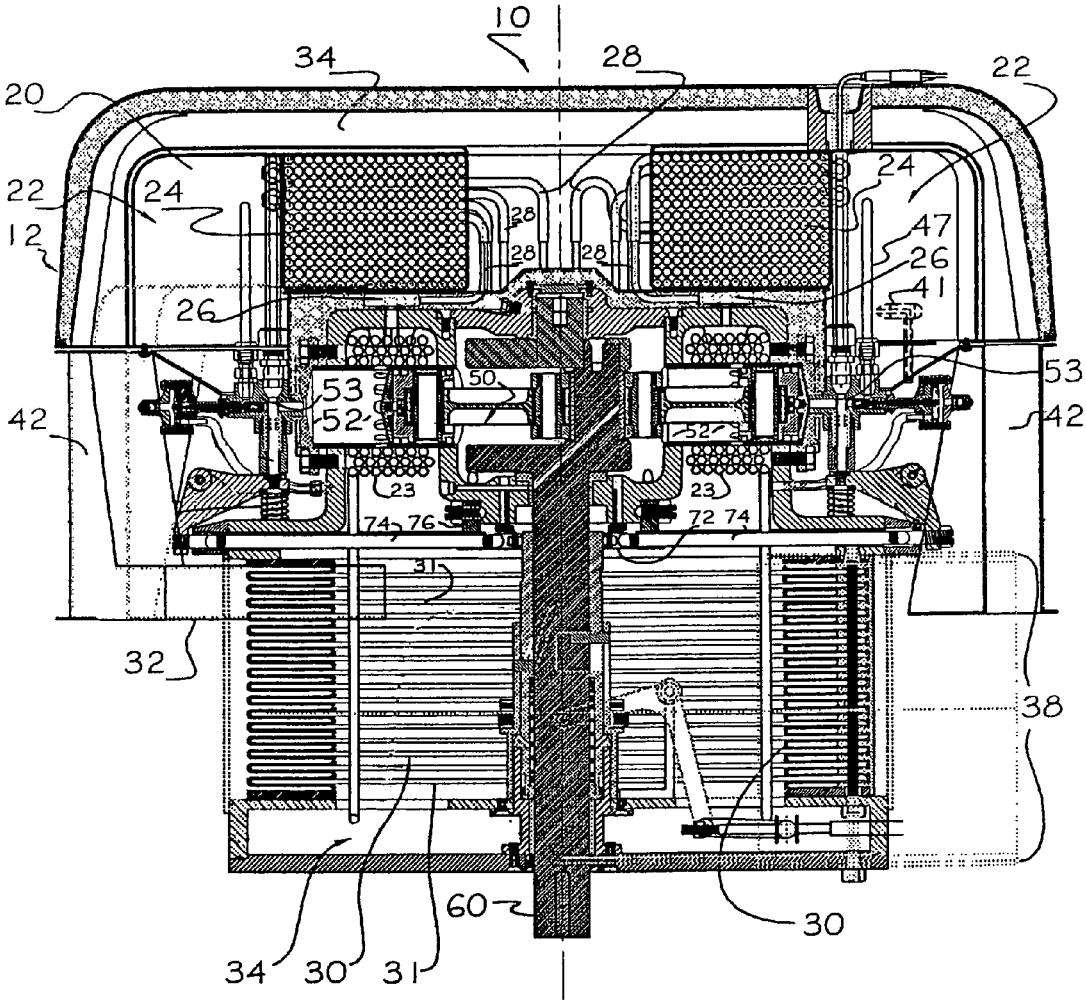
FIG. 2 is a side elevational view, shown in cross-section, illustrating the principal components of the engine.
Figure 3:
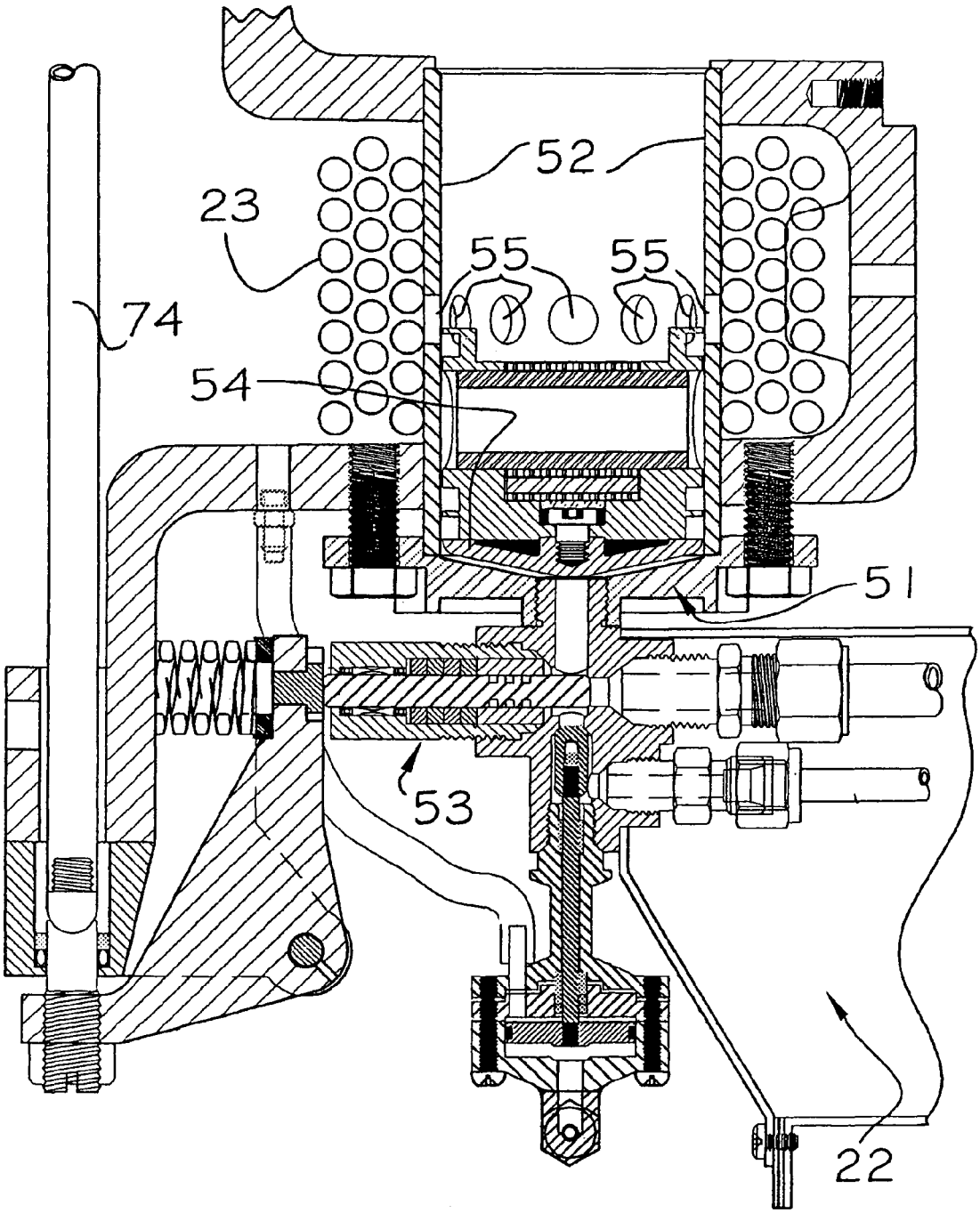
FIG. 3 is an isolated cross-sectional view showing a piston and cylinder with the pre-heater coil wound about the cylinder, adjacent to exhaust ports of the cylinder.

The present invention is directed to a pre-heater arrangement in a heat regenerative engine 10 for pre-heating water in its delivery path from a condenser sump 34 to a combustion chamber 22 in a steam generator 20 of the engine.

In operation, ambient air is introduced into condenser 30 by intake blowers 38. The air temperature is increased in two phases before entering the combustion chamber 22. The condenser 30 is a flat plate dynamic condenser with a stacked arrangement of flat plates 31 surrounding an inner core. This structural design of the dynamic condenser 30 allows for multiple passes of steam to enhance the condensing function. In a first phase, air enters the condenser 30 from the blowers 38 and is circulated over the condenser plates 31 to cool the outer surfaces of the plates and condense the exhaust steam circulating within the plates. More particularly, vapor exiting the exhaust ports 55 of the cylinders 52 passes through the pre-heating coils 23 surrounding the cylinders. The vapor drops into the core of the condenser 30 where centrifugal force from rotation of the crankshaft 60 drives the vapor into the inner cavities of the condenser plates 31. As the vapor changes phase into a liquid, it enters sealed ports on the periphery of the condenser plates. The condensed liquid drops through collection shafts and into the sump 34 at the base of the condenser. A high pressure pump 90 returns the liquid from the condenser sump 34 to the combustion chamber 22, completing the fluid cycle of the engine.

The engine shrouding 12 is an insulated cover that encloses the combustion chamber and piston assembly. The shroud 12 incorporates air transfer ducts 32 that channel air from the condenser 30, where it has been preheated, to the intake portion of air-to-air heat exchangers 42, where the air is further heated prior to entering the combustion chamber 22. The shroud also includes return ducts that capture the combustion exhaust gases at the top center of the combustion chamber, and leads these gases back through the exhaust portion of the air-to-air heat exchangers 42. The engine shrouding adds to the efficiency and compactness of the engine by conserving heat with its insulation, providing necessary ductwork for the airflow of the engine, and incorporating heat exchangers that harvest exhaust has heat.

The engine includes one or more piston and cylinder arrangements. Specifically, a cylinder 52 has a reciprocating piston head 54 movable in response to pressure of injected steam. A cam moves push-rods 74 to control opening of steam injection valves 53. At higher engine speeds, the steam injection valves 53 are fully opened to inject steam into the cylinders 52, causing piston heads 54 to be pushed radially inward. Movement of the piston heads 54 causes connecting rods to move radially inward to rotate a crank disk and crankshaft 60.

Water in its delivery path from the condenser sump pump 90 to the combustion chamber 22 is pumped via through one or more main steam supply lines 21 for each cylinder 52. The main steam line 21 passes through a pre-heating coil 23 that is wound around each cylinder skirt adjacent to that cylinder's exhaust ports 55. The vapor exiting the exhaust ports 55 gives up heat to this coil 23, which raises the temperature of the water being directed through the coil 23 toward the combustion chamber 30. Reciprocally, in giving up heat to the preheating coils, the exhaust vapor begins the process of cooling on its path through these coils preparatory to entering the condenser. The positioning of these coils 23 adjacent to the cylinder exhaust ports 55 scavenges heat that would otherwise be lost to the system, thereby contributing to the overall efficiency of the engine.

While the present invention has been shown and described in accordance with a preferred and practical embodiment thereof, it is recognized that departures from the instant disclosure are contemplated within the spirit and scope of the present invention.

What is claim is:

1. In an engine having a steam generator with a combustion chamber for producing pressurized steam, at least one conduit formed of a heat transferring material for directing water through a delivery path to the steam generator, at least one piston and cylinder arrangement for receiving pressurized steam in order to drive the piston within the cylinder, and a condenser;

a method comprising the steps of:

directing the at least one conduit through a coil wound about and surrounding the exterior of the cylinder and in heat transferring relation to exhaust ports of the cylinder;

releasing steam from the exhaust ports and over outer surfaces of the coils and transferring heat from the released steam and to the water in the coil in order to heat the water traveling through the coil along the delivery path to the steam generator;

cooling the steam as a result of the heat transfer to the coil; and directing the cooled steam to the condenser for condensing the steam to a liquid.

2. A water pre-heater in an engine having a steam generator with a combustion chamber, at least one conduit formed of a heat transferring material for delivering water through a delivery path to the steam generator, at least one piston and cylinder arrangement for receiving the pressurized steam in order to drive the piston within the cylinder, and a condenser;

said water pre-heater comprising:

at least one exhaust port associated with the cylinder for releasing the steam from within the cylinder after driving the piston; and a tubular coil connected in fluid flow relation to the conduit for passage of the water therethrough on its delivery path to the steam generator, and said tubular coil being wound about the cylinder so that the coil surrounds an exterior of the cylinder, in heat transferring relation to the at least one exhaust port, for transferring heat from the exhausted steam to the water traveling through the tubular coil, thereby heating the water on its path to the steam generator.

* * * * *